US005920291A

United States Patent [19]

Bosley

[11] Patent Number: 5,920,291

[45] Date of Patent: Jul. 6, 1999

[54] ANTENNA MOUNTING BRACKET AND ASSEMBLY

[75] Inventor: Larry R. Bosley, Bel Air, Md.

[73] Assignee: Baltimore Gas & Electric Company, Baltimore, Md.

[21] Appl. No.: 08/785,296

[22] Filed: Jan. 21, 1997

Related U.S. Application Data

[60] Provisional application No. 60/010,379, Jan. 22, 1996.

[51] Int. Cl.[6] ..... H01Q 1/12

[52] U.S. Cl. ..... 343/892; 343/890; 343/879

[58] Field of Search ..... 343/892, 890, 343/891, 878, 879, 882, 893; H01Q 1/12

[56] References Cited

U.S. PATENT DOCUMENTS

| | | | |
|---|---|---|---|
| 303,877 | 8/1884 | Neblett | 248/220.1 |
| 2,757,370 | 7/1956 | Scheldorf | 343/896 |
| 2,844,819 | 7/1958 | Andrews | 343/890 |
| 3,247,516 | 4/1966 | Rohn et al. | 343/890 |
| 3,299,429 | 1/1967 | McMullin | 343/796 |
| 3,318,561 | 5/1967 | Finke et al. | 343/890 |
| 3,394,377 | 7/1968 | Alford | 343/767 |
| 3,550,146 | 12/1970 | Eberle | 343/879 |
| 3,790,950 | 2/1974 | Smith et al. | 343/792.5 |
| 4,633,624 | 1/1987 | Targetti | 52/28 |
| 4,652,890 | 3/1987 | Crean | 343/882 |
| 4,745,412 | 5/1988 | Creaser, Jr. | 343/890 |

*Primary Examiner*—Hoanganh Le

*Attorney, Agent, or Firm*—Shlesinger Arkwright & Garvey LLP

[57] ABSTRACT

A mounting assembly for securing an antenna to a supporting structure, the assembly comprising a main frame including at least two frame members coaxially aligned about a common vertical axis, the main frame having an antenna mount end and a support mount end. The assembly further includes a main frame support extending transverse to each of the at least two frame members, the main frame support is connected to the main frame at the support mount for support thereof. A mounting bracket is provided for securing the main frame support to a supporting structure, for example an electric power transmission tower, and in a position adjacent thereto, the mounting bracket has a first end for connection to the main frame support and a second end for inner connection with the supporting structure whereby an antenna affixed to the main frame is secured to the supporting structure in a spaced relation therefrom.

19 Claims, 5 Drawing Sheets

ANTENNA MOUNTING BRACKET AND ASSEMBLY

CROSS-REFERENCE TO RELATED APPLICATIONS

This application is a continuation of U.S. provisional application Ser. No. 60/010,379, filed Jan. 22, 1996.

FIELD OF THE INVENTION

The present invention relates to an antenna mounting bracket and assembly for attaching wireless communication antennas onto utility power transmission structures or the like.

BACKGROUND OF THE INVENTION

In recent years, the telecommunication industry has seen an increase in personal communication systems which provide the consumer with wireless voice and data transmission. Wireless information transmission requires the provision of separate send and receive antennas operating at about 2,000 MHz frequency. These antennas must be positioned in an elevated manner and orientated to optimize signal reception and transmission.

For obvious reasons, it is desirable to avoid the construction of a dedicated tower for the antennas. Such structures are costly and have a high degree of impact upon the surrounding environment, particularly if located within a residential area. Pre-existing structures would therefore provide a more practical solution for mounting of the antenna. One such structure is the utility power transmission tower.

While electric power transmission towers could provide an economic and environmental advantage if adapted to function as an antenna support, such towers are not without problems. First, although wireless communication antennas may function with a six foot separation distance between the send and receive antennas, a separation distance of ten feet is highly preferred. Minimum distances must also be maintained from the high voltage conductors supported by the tower. These preferred distances are difficult to obtain at the top of the tower, an area already crowded not only by the high tension lines but also spars and related structural members. Since it is imperative the electric power transmission tower accommodate correctly spaced antennas, the antenna mount employed must be adapted to fit within the upper structures of the tower as well as provide the critical antenna spacing distances.

In addition, it is preferred to fit the top of the tower with a compliment of antennas covering a full 360°. Since the antennas are arranged in groups of send and receive antennas, this requires three separate sets of antennas oriented 120° apart from each other. Again, the structure of the tower itself may prevent this preferred orientation. In older tower constructions, the frame of the tower comprises four separate legs oriented 90° apart. If each group of antennas is mounted to a separate leg, the mount must allow for lateral adjustment of the antenna groups.

Because the clearances at the top of the tower are tight, assembly of the mounting bracket to the tower is a concern. A preferred bracket will have a compact, relatively low weight design that enables the workers to lift the cumbersome bracket without the need for heavy construction equipment or the drilling holes into the tower, therefore minimizing the likelihood of contact against a live high voltage line. The relatively large dimensions of the bracket mandate in situ fabrication. Thus, a preferred bracket design would allow for portions of the bracket to be assembled on the ground adjacent the tower site, and lifting of the subassembly into position using a pulley or other simple hoist prior to attachment to the tower.

Following attachment of the antenna group to the tower, it is of course necessary to orient the antennas if they are to be operable. A bracket permitting maximum adjustability is preferred since utility tower construction varies widely.

In view of the above, a need has existed in the art for an antenna mounting bracket and assembly that addresses each of the above noted problems.

OBJECTS AND SUMMARY OF THE INVENTION

It is therefore a primary object of the present invention to provide a bracket and related assembly for mounting an antenna to a tower structure and in particular the top of a pre-existing electric power transmission tower.

It is a further object of the present invention to provide a antenna mounting bracket and assembly having full adjustability to orient the antennas secured to the bracket assembly.

A still a further object of the present invention to provide an antenna mounting bracket and assembly that permits the mounting to the tower of a full compliment of antennas covering 360° at spaced angles of 120° between adjacent groups of antennas.

Yet a further object of the present invention is to provide a antenna mounting bracket and assembly that can be assembled on site and lifted into position in an efficient and safe manner.

Still further object of the present invention is to provide an antenna mounting bracket and assembly that is readily adapted to preexisting electric power transmission towers without the need to drill holes or otherwise modify the tower structure.

Yet another object of the present invention is to provide a bracket having two separate points of rotation, each of which permit lateral adjustment of the mounting bracket position relative to the tower through a horizontal plane, and a third adjustment of the antenna relative to the mounting bracket itself whereby maximum adjustability of antenna orientation is provided.

A still further object of the present invention is to provide a personal communication antenna that supports both send and receive antennas at optimal operational distances therebetween regardless of the electric power transmission tower construction.

In summary the present invention achieves the foregoing by providing a mounting assembly for securing an antenna to a supporting structure, the assembly comprising a main frame including at least two frame members coaxially aligned about a common vertical axis substantially parallel to the vertical axis of the supporting structure, the main frame having an antenna mount end and a support mount end. The assembly further includes a main frame support extending transverse to each of the at least two frame members, the main frame support connected to the main frame at a support mount end thereof. The bracket includes a bracket for securing the main frame support to the supporting structure and in a position adjacent thereto. The mounting bracket has a first end for connection to the main frame support and a second end for connection with the supporting structure whereby an antenna affixed to the main frame will be secured to the supporting structure in a spaced relation therefrom.

The present invention also relates to a mounting assembly for securing an antenna to a supporting structure wherein the mounting assembly comprising a main frame having a front face and two side faces, the front face configured to support an antenna, the side faces connected at respective first ends to the front face and interconnect at respective second ends. The mounting assembly includes a main frame support having a vertical axis, the main frame is pivotly connected to the main frame support at the second ends of the main frame two side faces for rotation about the vertical axis of the main frame support and a mounting bracket for securing the main frame support to a supporting structure and in a position adjacent thereto. The mounting bracket has a first end for connection to the main frame support and a second end for interconnection with a supporting structure whereby an antenna affixed to the main frame is adjustably secured to a supporting structure in a spaced relation therefrom.

The present invention also relates to a mounting assembly for securing an antenna to a utility power transmission structure, the mounting assembly comprising a main frame having a front face and two side faces, the front face including means for operably supporting an antenna, the two side faces connected at respective first ends to the front face and interconnected at respective second ends to provide a main frame having a substantially triangular configuration. Means for supporting the main frame are provided, the supporting means includes means for pivoting the main frame about a vertical axis thereof for adjusting the azimuth of an antenna secured thereto, the main frame pivoting means connected to the second ends of the two side faces and means for securing the main frame support means to a transmission structure wherein the vertical axis of the main frame is supported by the support means in a position substantially parallel to a longitudinal axis of the transmission structure.

These and other objects of the present invention will become apparent from the following detailed description.

DETAILED DESCRIPTION OF THE PREFERRED EMBODIMENT

Figures 1, 2, 3:
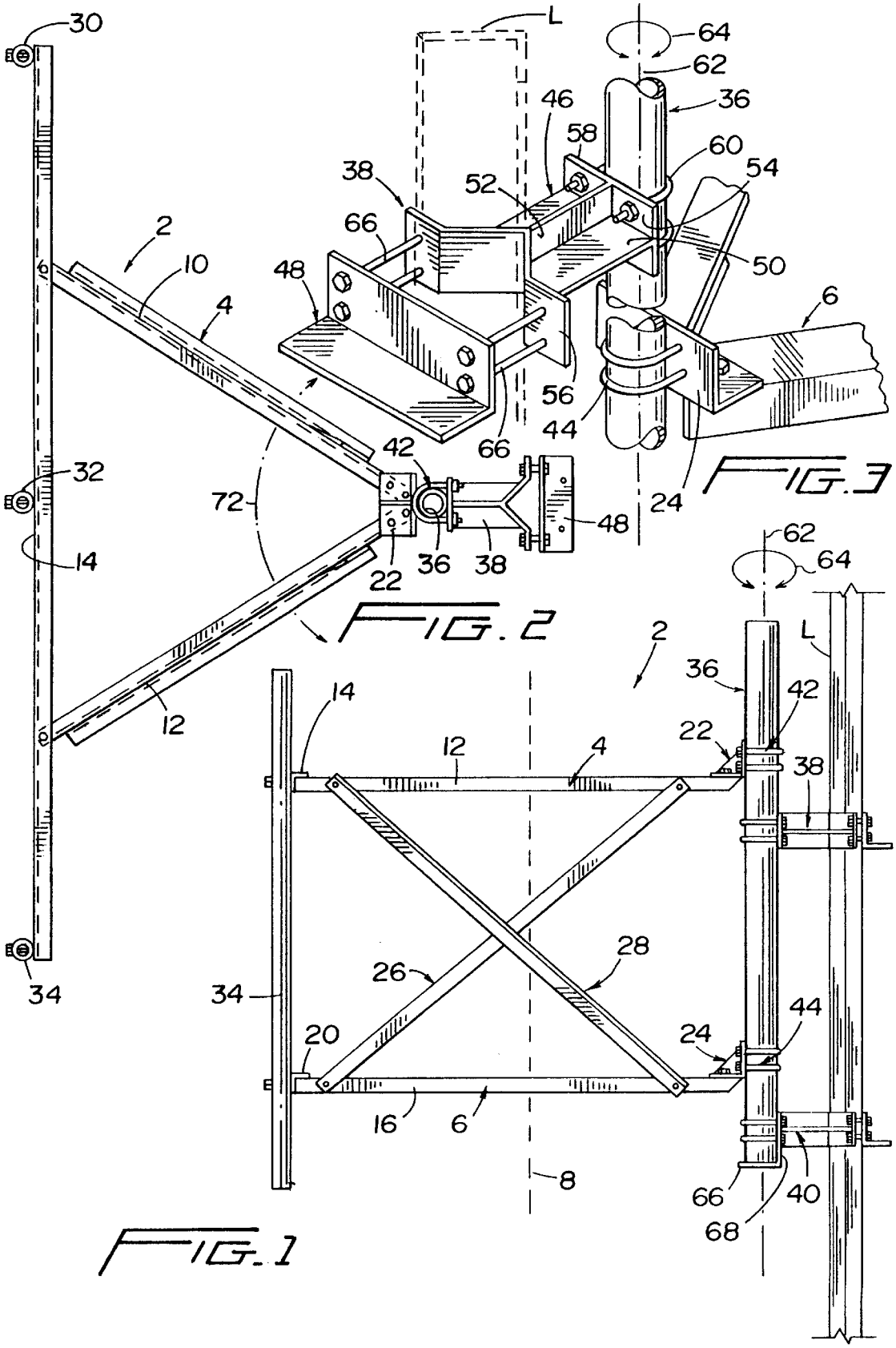
FIG. 1 is a side view of the antenna mounting bracket and assembly of the present invention attached to a leg of a electric transmission tower having portions thereof shown broken away.
FIG. 2 is a top plan view of the antenna mounting bracket and assembly shown in FIG. 1 without the leg of the electric transmission tower shown.
FIG. 3 is a perspective view of the bracket of the present invention attached to a leg of the electric transmission tower shown in phantom lines and showing the main frame and the main frame support member of the bracket with portions broken away therefrom.

Turning to FIGS. 1 and 2, the mounting bracket and assembly according to the present invention is shown. The assembly includes a three-sided main frame 2 having a substantially triangular cross-sectional shape through a horizontal plane. As best shown in FIG. 1, the main frame 2 includes at least two separate horizontal frame members 4 and 6 coaxially aligned about a common vertical axis 8 extending through main frame 2.

Each of the frame members 4 and 6 are similar in construction. As best shown in FIG. 2, frame member 4 comprises three separate spars namely side spar members 10 and 12 and front spar member 14 that which interconnect to form a generally triangular configuration. Bottom frame member 6 is likewise provided with a pair of side spars 16 and 18 (not shown) and a front spar 20. As best shown in FIG. 2, the front spar 14 of frame member 4 extends beyond the point of attachment to each of the side spars 10 and 12 and thus provides the requisite spacing for antennas secured to the front face of main frame 2. In a similar manner, the lower frame member 6 is likewise provided with a front spar 20 extending beyond the points of attachment to the respective side spars.

The side spars of each of the top frame member 4 and the bottom member 6 are interconnected at respective L-shaped brackets 22 and 24. The top frame member 4 and bottom frame member 6 are interconnected about each side of frame 2 by separate pairs of brace members 26 and 28 having a generally X-shaped configuration. As can be seen, brace members 26 and 28 extend and are connected to each of the corresponding frame members 4 and 6 at their respective side spars. In addition, the frame members 4 and 6 are interconnected at the respective front spars 14 and 20 by way of vertical supports or pipes 30, 32 and 34 which, together with additional elements of the present invention, form a support member for the wireless antennas as will be further explained below. Each of the vertical supports 30, 32 and 34 may be fastened by bolt or other device to the respective frame members. As best shown in FIG. 2, the vertical supports 30, 32 and 34 are evenly spaced apart along the front spars 14 and 20.

Turning to FIGS. 1 and 3, the main frame support member 36 and associated mounting brackets 38 and 40 are shown. The main frame support member 36 has a longitudinal axis 62 extending transverse to each of frame members 4 and 6 and substantially parallel to the vertical axis 8 of the main frame 2. The main frame support member 36 is configured as a pipe having a smooth external surface throughout. It is preferred that main frame 2 be adjustably secured to the main frame support member 36 at each of the main frame L-shaped brackets 22 and 24 to permit the main frame to pivot laterally about the support member 36. In this regard, the L-shaped brackets 22 and 24 may be secured to the main frame support member by way of paired U-bolts 42 and 44 positioned about the main frame support member 36 as shown and including a tightening nuts. Main frame 2 may be repositioned relative to support member 36 by loosening of U-bolt pairs 42 and 44 and pivotally rotating the main frame 2 about frame support 36 in either direction of arrow 64. As is apparent, alternative mechanisms for securing the main frame 2 to the main frame support member 36 are within the scope of the present invention. For example, a strap device or hinge mechanism could be substituted for the bracket and U-bolt arrangement.

Turning to FIG. 3, the mounting bracket 38 is shown in greater detail. Mounting bracket 38 comprises a main body portion 46 and cooperating L-shape clamp portion 48. The main body portion 46 includes an elongated central portion 50 having reinforcing rib 52 and respective flange members 54 and 56 positioned at each end. Flange member 54 has a planar surface extending transverse to that of central portion 50 and abuts against frame support 36 at external surface 58. Flange 54 includes securing member 60 comprising a pair of parallel U-bolts and nuts operable in a manner similar to that as set forth with respect to main frame 2. Thus, following loosening of the U-bolts and nuts, the main frame support member 36 may be selectively rotated about longitudinal axis 62 and in either direction of arrow 64. Following rotation of the support member 36 (and co-extensively the main frame 2), locking bolts may be tightened to fix the positioning of main frame support member 36 in a secure position against main body portion 46.

At the opposite end of bracket main body portion 46 is flange 56 positioned transverse to the longitudinal axis of central portion 50 and configured to receive a leg L of a utility power transmission structure (not shown). An L-shaped clamp member 48 is provided and cooperates with flange 56. Bolts 66 interconnect main body portion 46 to clamp member 48 and provide clamping action to rigidly secure mounting bracket 38 to a leg L of a utility power transmission structure. As best shown in FIG. 1, the bracket 38 functions to position the main frame support member 36 in a manner spaced from and substantially parallel to the longitudinal axis of the utility power transmission structure. The main frame support member 36 is shown to be attached to the leg L by a pair of brackets 38 and 40 substantially aligned along the vertical axis of the tower leg. Mounting bracket 40 is substantially similar in construction to that of bracket 38 described above but is further provided with a stop member 66 upon which the bottom end of main frame support member 36 may rest. The stop member 66 is shown to be integral with the flange 68 of mounting bracket 40 and disposed at a right angle thereto.

While the above description discloses a pair of mounting brackets 38 and 40, it is within the scope of the present invention to provide other brackets within the scope of the present invention. For example, the mounting bracket could comprise a single integral bracket where a separate pair of arms are provided in place of individual brackets 38 and 40. Further, the locking means for securing the bracket to the leg L and the support member 36 may be modified in the manner as noted earlier. In all cases the mounting bracket should function to position the support member 36 in a spaced relation from the tower for receiving the main frame 2.

Figure 4:
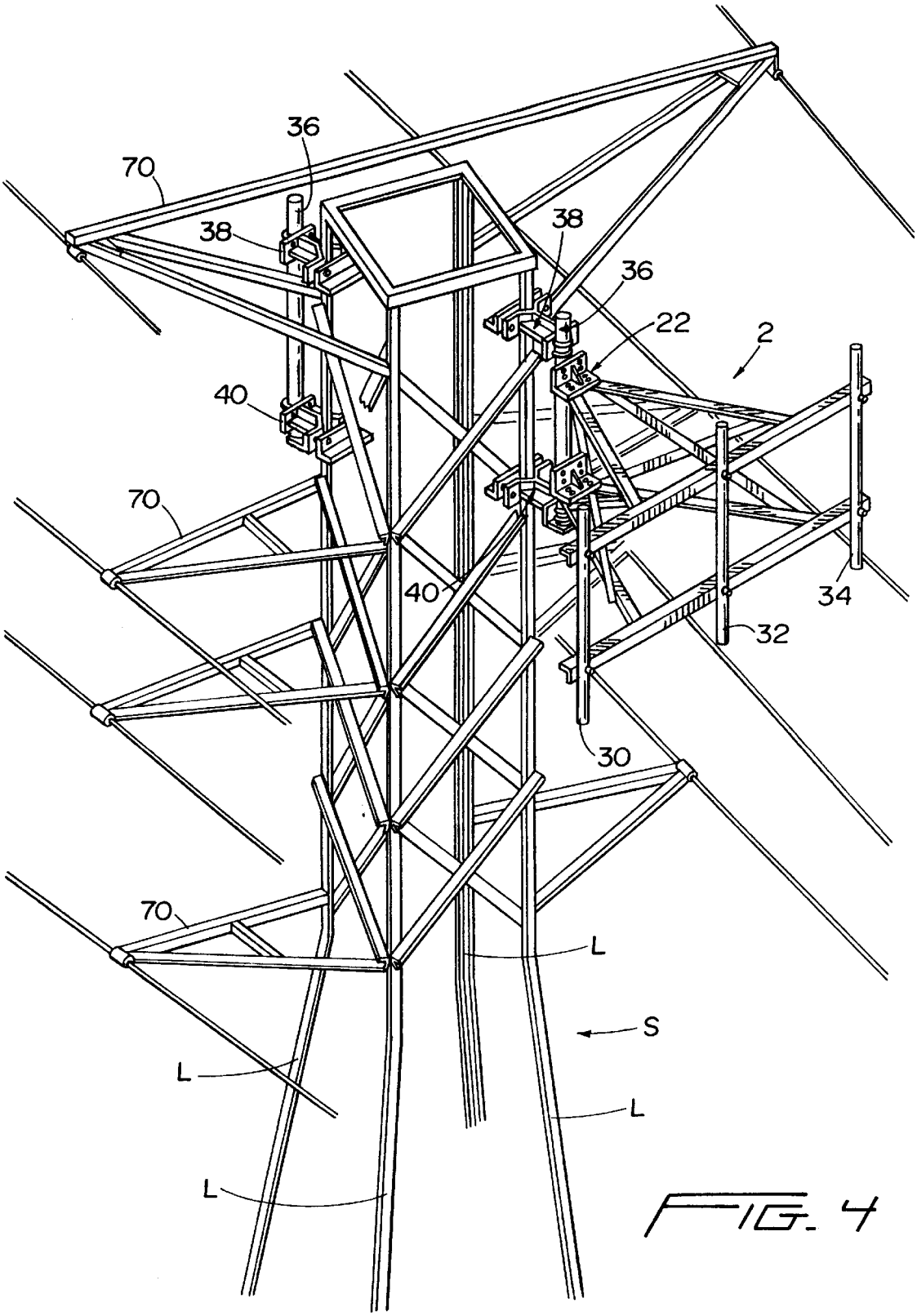
FIG. 4 is a perspective view of the present invention showing both partially and fully assembled antenna mounting bracket and assemblies secured to the top of an electric power transmission tower.

Turning to FIG. 4, the antenna mounting bracket and assembly is shown both partially and fully assembled in connection with a utility power transmission structure S. The utility tower S includes four separate tower legs L each of which are oriented 90° relative to each other. Extending from tower legs L are lateral tension wire supports or spars 70 in vertical alignment and in a manner as is known in the art. A main frame support member 36 without a main frame is shown attached to the tower S and at the opposite side of the tower S a fully assembled antenna support including main frame 2 and support member 36 is shown.

To assemble, a main frame support member 36 and associated pair of mounting brackets 38 and 40 are lifted into place adjacent the leg of a tower. The brackets 38 and 40 are secured to the tower leg in a manner as set forth above. The support member 36 is likewise secured by appropriate bolts or other devices to the brackets to thereby position the support member in a manner as shown in FIG. 4. Following attachment of the brackets 38 and 40 and support member 36 to the tower leg, the main frame 2 may be lifted into position adjacent the subassembly and secured to the support member 36. The antenna mounting bracket and subassembly according to the present invention is configured to accommodate a gin pole and pulley arrangement or other hoist device for easy assembly to the tower. A worker simply assembles the main frame support member and associated mounting brackets to the leg of a utility tower and then uses a relatively lightweight pulley arrangement to lift the associated main frame into place for attachment to the support member 36.

Following attachment of the main frame 2 to a respective main frame support member 36, the main frame 2 may be reoriented by loosening of the associated U-bolts pairs 42 and 44 and selectively moving the main frame through a horizontal plane and in the direction of arrow 72 in FIG. 2. The support member 36 can likewise be rotated about axis 62 and in a direction of arrow 64 to further adjust positioning of the main frame 2. Following orientation, the respective pairs of U-bolts 42 and 44 are re-tightened to thereby lock the main frame into the desired position. Depending upon the construction of the utility power transmission structure S as well as the number of main frames secured to a particular tower, the dual positioning feature of the main frame provides adjustability and enhanced orientation.

As noted earlier, the present invention permits mounting of three separate main frames onto a four legged utility tower, each in the manner shown in FIG. 4. A third mounting bracket and assembly would therefore be secured to a third leg of the tower (not shown) after which each main frame is rotated laterally and in the direction of arrow 72 of FIG. 2 to provide a full compliment of antennas that can be spaced 120° apart. Thus, full use of the available tower space is provided.

Figure 5:
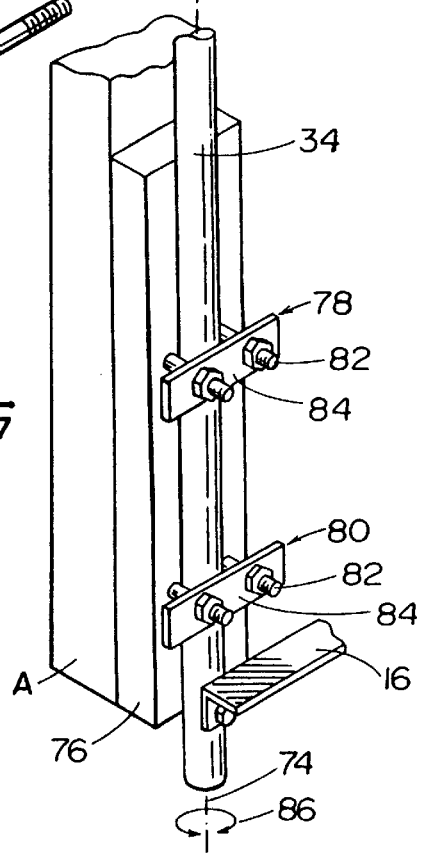
FIG. 5 is an enlarged perspective view of the mounting assembly of the present invention for securing an antenna to the main frame element with portions thereof shown broken away.

Turning to FIG. 5, an adjustable mounting assembly for attaching an antenna to a respective vertical support pipe 34 is shown and includes an antenna support member 76 secured to the outward facing surface of the vertical support pipe 32 by way of adjustable lock device 78 and 80. Each respective adjustable lock device is shown to comprise a clamp member consisting of bolt and plate members 82 and 84 for positioning the vertical support pipe in a locking orientation between the back surface of antenna support member 76 and the plate 84. An antenna A is secured to the outward face of the antenna support member 76 in a known manner whereby the functional surface of the antenna is facing outwardly in an operable position. In this manner, the antenna A can be adjusted to rotate laterally about axis 74 and in the direction of arrow 86. Such rotation provides further adjustment of the azimuth following lateral adjustment of the main frame 2 as set forth earlier. Following adjustment, the antenna A is secured in place by tightening of the respective bolt and nut arrangement. As is apparent, other adjustment devices are within the scope of the present invention, provided they permit pivoting of the antenna in the manner as set forth above.

Turning now to FIGS. 6 through 9 an alternative embodiment of the antenna mounting bracket and assembly according to the present invention is shown. In this embodiment, the antenna bracket is adapted to be secured to a utility power transmission structure S having a design different from that as shown in FIG. 4. More particularly, the utility power transmission structure of FIG. 9 comprises a tower structure S having a single central pole P. In this embodiment, the mounting bracket for securing the main frame support member 36 to the tower pole P of the utility structure S comprises a strap member 88. Strap member 88 is shown to comprise a series of links and clamps of metal construction, such as steel. The length of the strap may be adjusted through the addition or removal of several links. The main frame 2 including respective frame support member 36 are substantially similar to that as earlier described.

Figure 6:
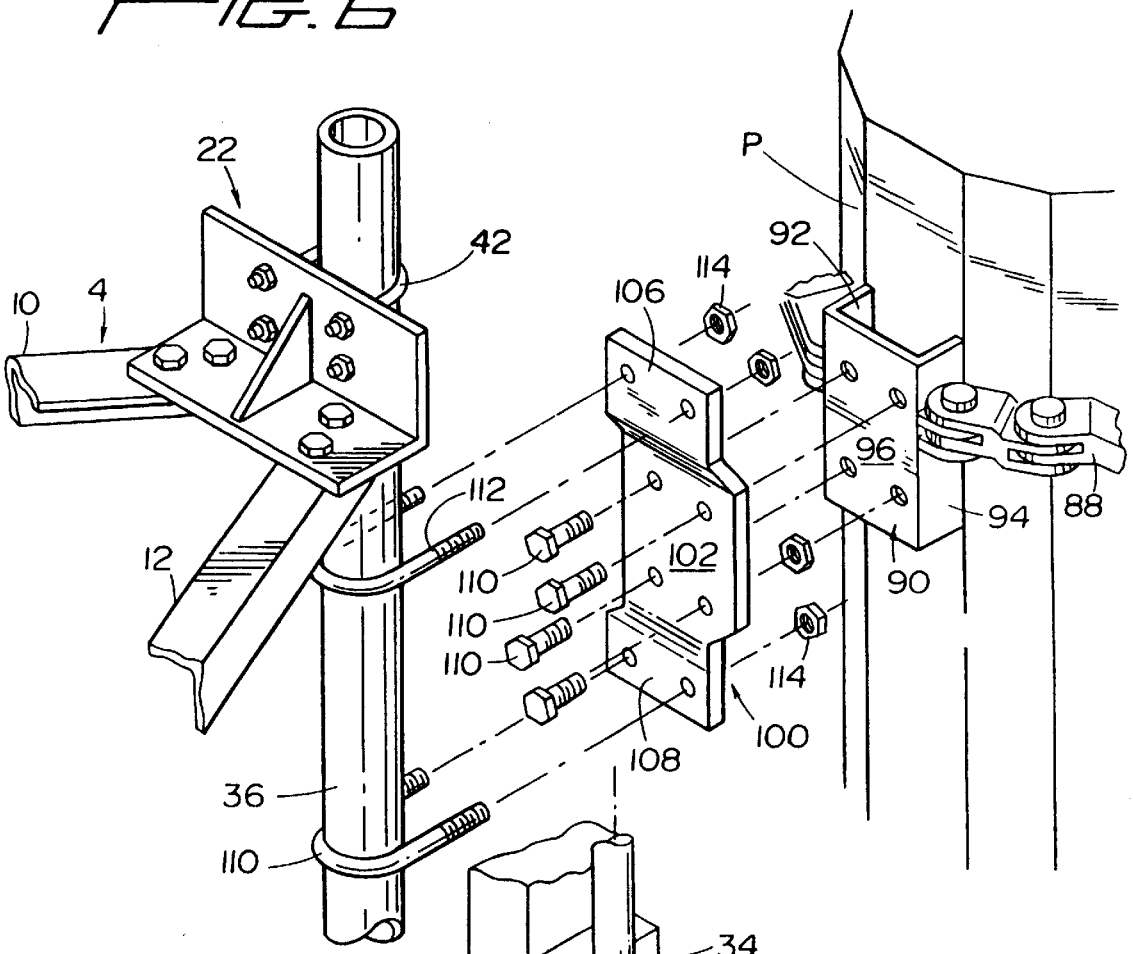
FIG. 6 is an exploded perspective view of an alternative embodiment of the present invention with portions of the main frame, main frame support and transmission tower pole shown broken away.
Figure 7:
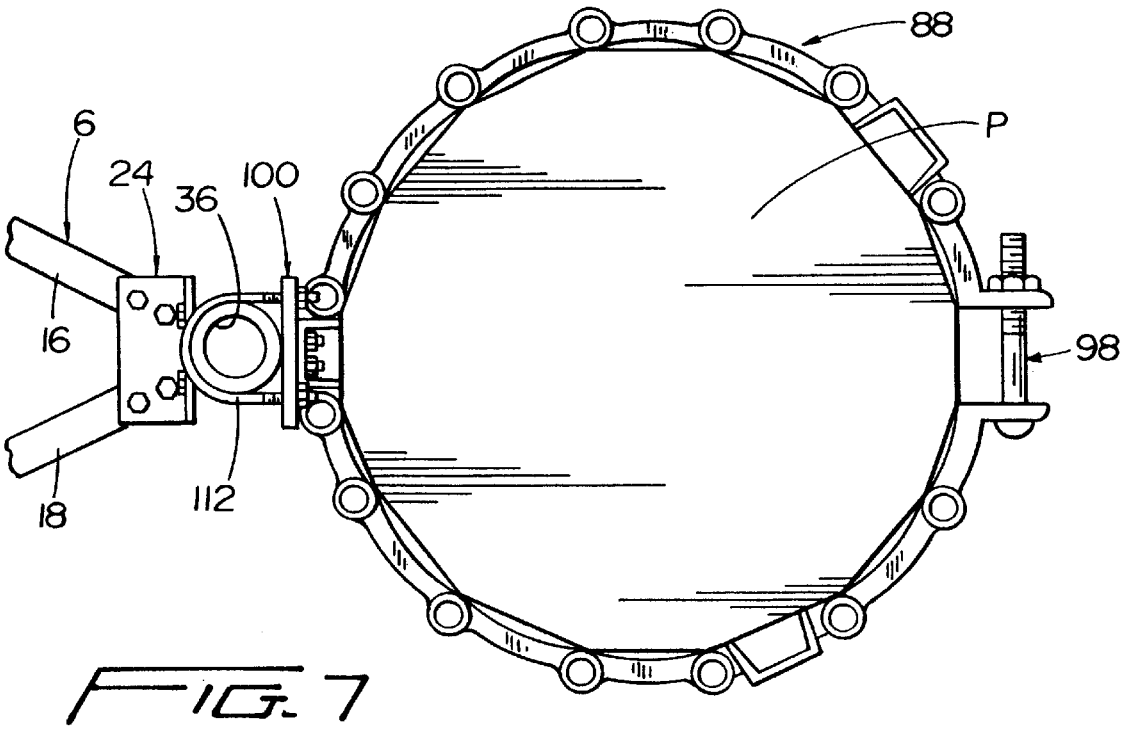
FIG. 7 is a top plan view of FIG. 6 and further illustrating the strap member and transmission tower pole.
Figure 8:
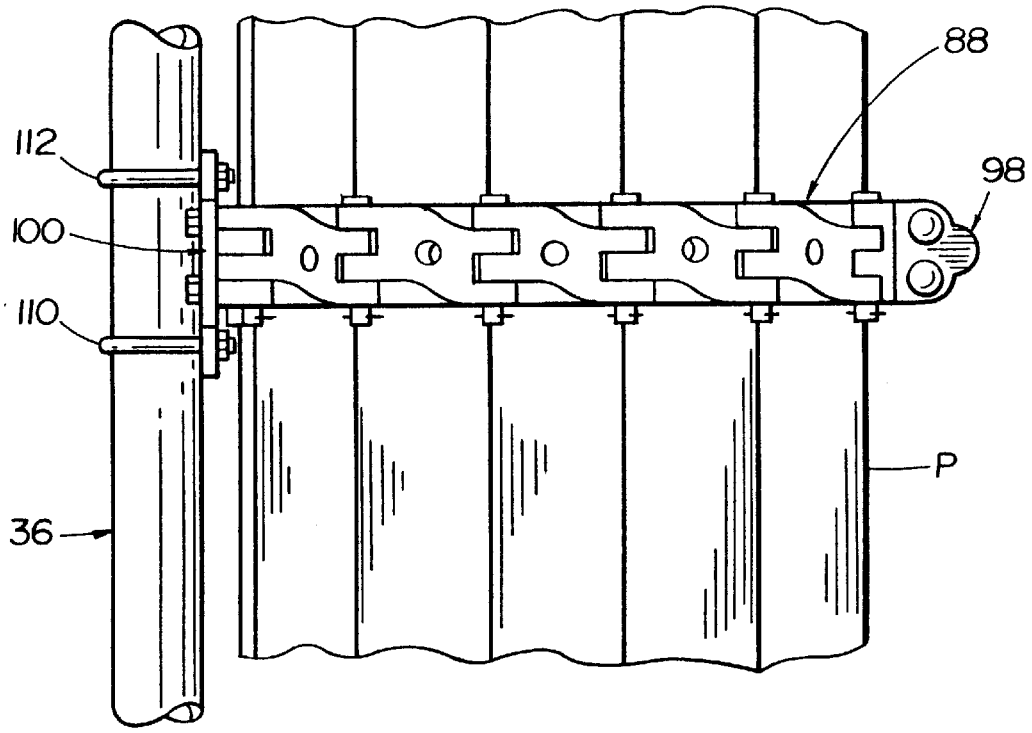
FIG. 8 is a side view of FIG. 7 without the main frame and showing portions of the transmission tower pole broken away.

A mounting bracket 90 is provided and comprises a generally U-shaped member having a pair of stand-off legs 92 and 94 resting against the surface of the pole P and providing a raised surface 96 extending outwardly from the pole P. As best shown in FIGS. 6 and 7, the mounting bracket is attached to the strap 88 which comprises a linkage device having a tightening device 98 at one end thereof. Also forming part of mounting bracket 90 is adaptor plate 100 comprising a central body portion 102 and flange portions 106 and 108 which provide a raised surface from connector portion 102. Connector portion 102 and raised surface 96 of mounting bracket 90 are secured in a mating relation by appropriate screw and bolt members 110 or other device for securing the adapter plate to the mounting bracket 90. Conversely, flanges 106 and 108 provide a mounting surface for the main frame support member 36 and as illustrated in FIG. 6, a U-bolt 112 and nut 114 provides an adjustable means for securing the support member 36 against the raised surfaces of the flanges 106. As set forth above regarding the embodiment in FIGS. 1 through 3, the U-bolt may be selectively loosened to permit axial rotation of the main frame support member 36 and thus adjustment to the position of the main frame 2 (not shown). As best shown in FIG. 8, the mounting bracket in this embodiment comprising an adaptor plate 100 and mounting bracket 90 that together enable the main frame support member 36 to be spaced from the tower pole P substantially parallel to the pole.

Figure 9:
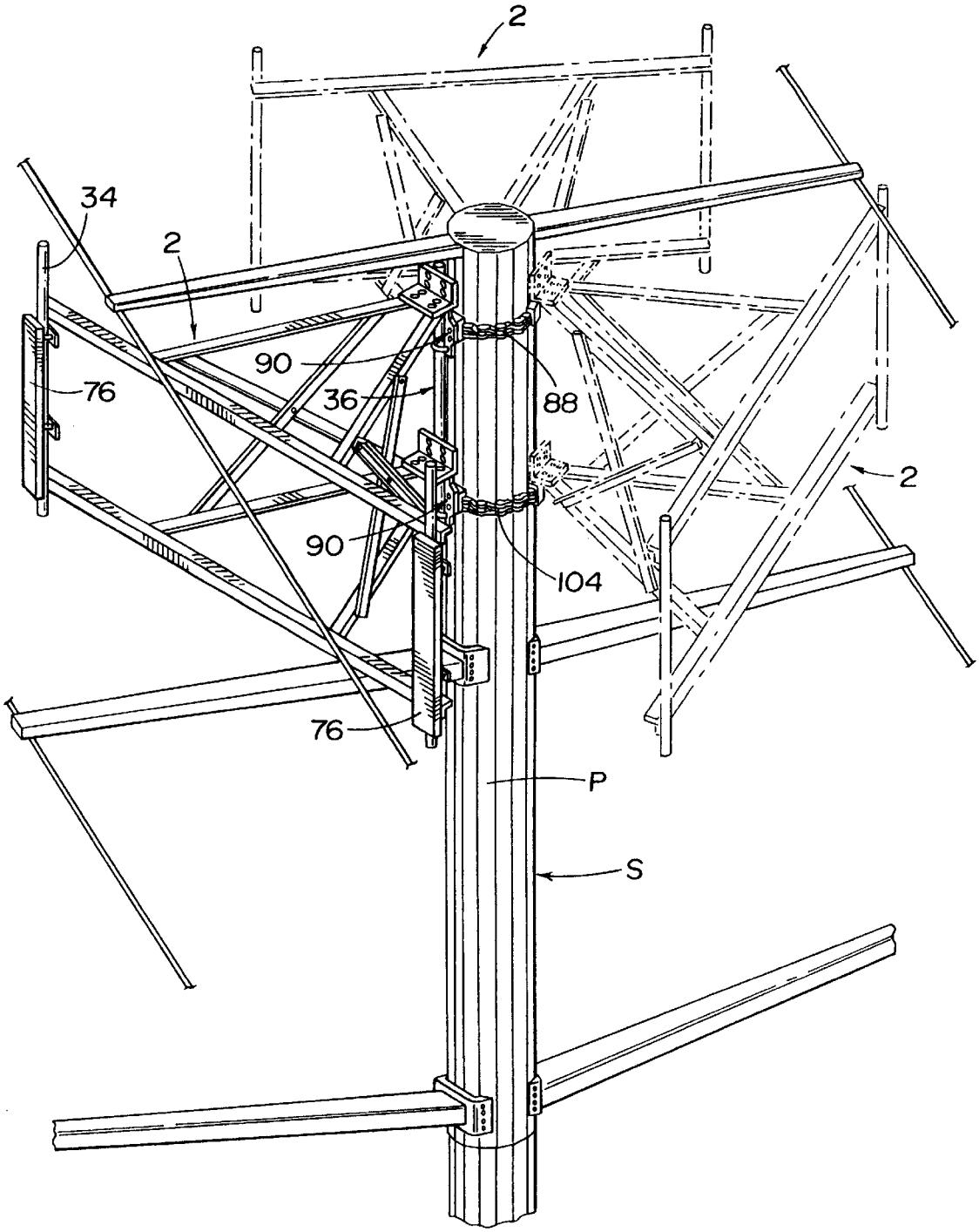
FIG. 9 is a perspective view of the alternative embodiment of the present invention shown in FIGS. 6 through 9 secured to a transmission tower pole and with two of the antenna mounting bracket assemblies shown in phantom lines.

Turning to FIG. 9, three main frames including mounting bracket assemblies are shown secured to a utility power transmission structure S using the antenna mounting bracket and assembly according to the present embodiment. As can be seen, a pair of straps 88 and 104 are provided to secure respective main frame support members 36 to the tower pole P using a pair of mounting brackets 90 positioned at the upper portion of the main frame support member and lower portion thereof. Further additional main frame support members may be positioned on the strap members 104 and 88 to provide two additional antenna supports and as shown in phantom lines. As can be seen, each main frame is positioned 120° apart from each other to provide the 360° operation of the antennas when secured to the main frames. As with the previous embodiment, each individual main frame can be adjusted to rotate about the respective main frame support member secured into place to provide a fine-tune adjustment of the azimuth of each of the antennas.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What I claim is:

1. A mounting assembly for securing an antenna to a supporting structure comprising:

a) a main frame including at least two, substantially parallel frame members coaxially aligned about a common vertical axis, said main frame having an antenna mount end and a support mount end;

b) a main frame support extending transverse to each of said at least two frame members;

c) a main frame mount interconnecting said main frame and said main frame support and adapted to permit rotation of said main frame about the vertical axis of said main frame support;

d) a mounting bracket having first and second ends, said mounting bracket extending between said main frame support and the supporting structure for interconnection therebetween so that said main frame mount is displaced away from the supporting structure throughout its length thereof, said mounting bracket first end connected to said main frame support and adapted to permit adjustable rotation of each of said main frame and said main frame support about a vertical axis thereof, said mounting bracket second end adapted for interconnection to the supporting structure.

2. The mounting assembly as in claim 1 and further comprising at least one brace member, said at least one brace member extending between said at least two frame members and interconnected therewith to provide support therebetween.

3. The mounting assembly as in claim 1 and wherein each of said at least two frame members having a generally triangular configuration.

4. The mounting assembly as in claim 1 and wherein said main frame support comprising a rigid leg extending substantially perpendicular to said at least two frame members and having a continuous surface thereon configured for sliding engagement against said main frame mount.

5. The mounting assembly as in claim 4 and wherein said mounting bracket comprising at least two spacer members having clamps provided at respective end portions for attachment to said main frame support and the supporting structure respectively.

6. The mounting assembly as in claim 5 and wherein at least one of said clamps comprising a U-bolt operatively associated with a plate member and configured for positioning about said rigid leg.

7. The mounting assembly as in claim 5 and wherein at least one of said clamps comprising a pair of cooperating plate members operatively associated with locking bolts, said pair of cooperating plate members configured to receive at least one of said rigid leg or a surface of the supporting structure therebetween.

8. The mounting assembly as in claim 1 and wherein said main frame mount comprising at least one plate member affixed to said main frame at said support mount end and a leg lock operatively associated therewith for selectively locking said main frame to said main frame support in a fixed position.

9. The mounting assembly as in claim 1 and further including at least one antenna support member extending perpendicular to said at least two frame members and secured thereto at said main frame antenna mount end, said at least one antenna support member including an adjustable antenna mount to permit positional adjustment of the antenna about a vertical axis thereof.

10. The mounting assembly as in claim 9 and wherein said adjustable antenna mount comprising a lock member operatively associated with said at least one antenna support member for positional locking of the antenna thereagainst.

11. The mounting assembly as in claim 10 and wherein:

a) said at least one antenna support member comprising a rigid leg; and b) said lock member comprising a U-bolt positioned about said antenna support member and configured for interconnection with the antenna.

12. The mounting assembly as in claim 1 and wherein each of said mounting bracket first and second ends provided with respective clamp members for securing thereto said frame support member and the supporting structure respectively, at least one of said clamp members including a stop member for supporting said main frame support at a lower end thereof.

13. The mounting assembly as in claim 12 and wherein:

a) said first end clamp member is a plate and U-bolt device for receiving said main frame support therebetween; and b) said second end clamp member is a strap device configured to receive the supporting structure.

14. The mounting assembly as in claim 13 and wherein:

a) said first end clamp member is a plate extending transverse to the longitudinal axis of said bracket and further including a U-bolt device operatively associated therewith for receiving said main frame support in clamping relation therebetween; and b) said second end clamp member comprising a pair of cooperating parallel plates extending transverse to the longitudinal axis of said bracket and further including a tightening device operatively associated therewith for receiving at least a portion of the supporting structure in a clamping relation therebetween.

15. A mounting assembly for securing an antenna to a supporting structure comprising:

a) a main frame having a front face and two side faces, said front face configured to support the antenna, said side faces connected at respective first ends to said front face and interconnected at respective second ends;

b) a main frame support having a vertical axis, c) a main frame mount interconnecting said main frame and said main frame support and adapted to permit rotation of said main frame about the vertical axis of said main frame support;

d) a mounting bracket having first and second ends, said mounting bracket extending between said main frame support and the supporting structure for interconnection therebetween so that said main frame mount is displaced away from the supporting structure throughout its length thereof, said mounting bracket first end connected to said main frame support and adapted to permit adjustable rotation of each of said main frame and said main frame support about a vertical axis thereof, said mounting bracket second end adapted for interconnection to the supporting structure.

16. The mounting assembly as in claim 15 and wherein said main frame support comprising a rigid leg member, said rigid leg member is pivotally connected to said main frame support by a hinge device.

17. The mounting assembly as in claim 15 and wherein said front face including an adjustable antenna mount to mount the antenna thereto and permit rotational adjustment of the antenna about a vertical axis thereof.

18. The mounting assembly as in claim 15 and wherein said mounting bracket comprising at least two separate spacer members having clamps provided at the respective said end portions thereof for connection to each of said main frame support and the supporting structure respectively.

19. A mounting assembly for securing an antenna to a utility power transmission structure, said mounting assembly comprising:

a) a main frame having a front face and two side faces, said front face including means for operably supporting the antenna, said two side faces connected at respective first ends to said front face and interconnected at respective second ends to provide a main frame having a substantially triangular configuration;

b) means for supporting said main frame, said supporting means including means for pivoting said main frame about a vertical axis thereof to adjust the azimuth of the antenna secured thereto, said main frame pivoting means connected to said second ends of said two side faces; and c) means for securing said main frame support means to a transmission structure wherein the vertical axis of said main frame is supported by said support means in a position substantially parallel to the longitudinal axis of the transmission structure.

* * * * *